US007549489B2

(12) United States Patent
Hall et al.

(10) Patent No.: US 7,549,489 B2
(45) Date of Patent: Jun. 23, 2009

(54) JACK ELEMENT WITH A STOP-OFF

(76) Inventors: David R. Hall, 2185 S. Larsen Pkwy., Provo, UT (US) 84606; Ronald Crockett, 2185 S. Larsen Pkwy., Payson, UT (US) 84606; John Bailey, 2185 S. Larsen Pkwy., Provo, UT (US) 84606

( * ) Notice: Subject to any disclaimer, the term of this patent is extended or adjusted under 35 U.S.C. 154(b) by 172 days.

(21) Appl. No.: 11/750,700

(22) Filed: May 18, 2007

(65) Prior Publication Data

US 2007/0221415 A1 Sep. 27, 2007

Related U.S. Application Data

(63) Continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, application No. 11/750,700, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 10/26* (2006.01)
*E21B 10/54* (2006.01)

(52) U.S. Cl. ..... 175/385; 175/426

(58) Field of Classification Search ..... 175/385, 175/426, 433–435
See application file for complete search history.

(56) References Cited

U.S. PATENT DOCUMENTS 4,535,853 A * 8/1985 Ippolito et al. ..... 175/404
4,683,781 A * 8/1987 Kar et al. ..... 76/108.2

(Continued)

*Primary Examiner*—Hoang Dang
(74) *Attorney, Agent, or Firm*—Tyson J. Wilde

(57) ABSTRACT

In one aspect of the present invention, a drill bit has a body intermediate a shank and a working face, the working face comprising a plurality of blades formed on the working face and extending outwardly from the bit body. Each blade comprises at least one cutting element. The drill bit also has a jack element coaxial with an axis of rotation and extending out of an opening formed in the working face. A portion of the jack element is coated with a stop-off.

10 Claims, 8 Drawing Sheets

U.S. PATENT DOCUMENTS 4,907,665 A * 3/1990 Kar et al. ..... 175/426
5,732,784 A * 3/1998 Nelson ..... 175/385
5,794,728 A * 8/1998 Palmberg ..... 175/400
5,833,021 A * 11/1998 Mensa-Wilmot et al. .... 175/433
6,131,675 A * 10/2000 Anderson ..... 175/268
6,454,030 B1 * 9/2002 Findley et al. ..... 175/425

* cited by examiner

JACK ELEMENT WITH A STOP-OFF

CROSS REFERENCE TO RELATED APPLICATIONS

This Patent Application is a continuation-in-part of U.S. patent application Ser. No. 11/737,034 filed on Apr. 18, 2007, now U.S. Pat. No. 7,503,405 and entitled Rotary Valve for Steering a Drill Bit. U.S. patent application Ser. No. 11/737,034 is a continuation-in-part of U.S. patent application Ser. No. 11/686,638, now U.S. Pat. No. 7,424,922, filed on Mar. 15, 2007 and entitled Rotary Valve for a Jack Hammer. U.S. patent application Ser. No. 11/686,638 is a continuation-in-part of U.S. patent application Ser. No. 11/680,997, now U.S. Pat. No. 7,419,016, filed on Mar. 1, 2007 and entitled Bi-center Drill Bit. U.S. patent application Ser. No. 11/680,997 is a continuation-in-part of U.S. patent application Ser. No. 11/673,872, now U.S. Pat. No. 7,484,576, filed on Feb. 12, 2007 and entitled Jack Element in Communication with an Electric Motor and/or generator. U.S. patent application Ser. No. 11/673,872 is a continuation-in-part of U.S. patent application Ser. No. 11/611,310, now U.S. Patent Publication No. 2008/0142264, filed on Dec. 15, 2006 and which is entitled System for Steering a Drill String. This Patent Application is also a continuation-in-part of U.S. patent application Ser. No. 11/278,935, now U.S. Pat. No. 7,426,968, filed on Apr. 6, 2006 and which is entitled Drill Bit Assembly with a Probe. U.S. patent application Ser. No. 11/278,935 is a continuation-in-part of U.S. patent application Ser. No. 11/277,394, now U.S. Pat. No. 7,398,837, which filed on Mar. 24, 2006 and entitled Drill Bit Assembly with a Logging Device. U.S. patent application Ser. No. 11/277,394 is a continuation-in-part of U.S. patent application Ser. No. 11/277,380, now U.S. Pat. No. 7,337,858, also filed on Mar. 24, 2006 and entitled A Drill Bit Assembly Adapted to Provide Power Downhole. U.S. patent application Ser. No. 11/277,380 is a continuation-in-part of U.S. patent application Ser. No. 11/306,976, now U.S. Pat. No. 7,360,610, which was filed on Jan. 18, 2006 and entitled "Drill Bit Assembly for Directional Drilling." U.S. patent application Ser. No. 11/306,976 is a continuation-in-part of 11/306,307, now U.S. Pat. No. 7,225,886, filed on Dec. 22, 2005, entitled Drill Bit Assembly with an Indenting Member. U.S. patent application Ser. No. 11/306,307 is a continuation-in-part of U.S. patent application Ser. No. 11/306,022, now U.S. Pat. No. 7,198,119, filed on Dec. 14, 2005, entitled Hydraulic Drill Bit Assembly. U.S. patent application Ser. No. 11/306,022 is a continuation-in-part of U.S. patent application Ser. No. 11/164,391, now U.S. Pat. No. 7,270,196, filed on Nov. 21, 2005, which is entitled Drill Bit Assembly. All of these applications are herein incorporated by reference in their entirety.

BACKGROUND OF THE INVENTION

The present invention relates to the manufacturing of drill bit assemblies for use in oil, gas and geothermal drilling. Drill bits typically have a number of cutting elements brazed onto a drill bit body. Such cutting elements generally comprise a diamond surface bonded to a carbide substrate, which substrate is generally brazed into pocket formed in the body of the drill bit.

U.S. Pat. No. 4,711,144 to Barr et al., which is herein incorporated by reference for all that it contains, discloses a method of mounting a cutter, having a stud portion defining one end thereof and a cutting formation generally adjacent the other end, in a pocket in a drill bit body member. The method includes the steps of forming a channel extending into the pocket, inserting brazing material into the channel, inserting the stud portion of the cutter assembly into the pocket, then heating the bit body member to cause the brazing material to flow through the channel into the pocket, and finally re-cooling the bit body member. During the assembly of the various pieces required in the steps mentioned immediately above, a spring is used, cooperative between the cutter and the bit body member, to retain the stud portion in the pocket and also to displace the stud portion toward the trailing side of the pocket.

BRIEF SUMMARY OF THE INVENTION

In one aspect of the present invention, a drill bit has a body intermediate a shank and a working face, the working face comprising a plurality of blades formed on the working face and extending outwardly from the bit body. Each blade comprises at least one cutting element. The drill bit also has a jack element coaxial with an axis of rotation and extending out of an opening formed in the working face. A portion of the jack element is coated with a stop-off.

A superhard tip may be bonded to a distal end of the jack element. The superhard tip may comprise a material selected from the group consisting of diamond, polycrystalline diamond, natural diamond, synthetic diamond, vapor deposited diamond, silicon bonded diamond, cobalt bonded diamond, thermally stable diamond, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The jack element may have a surface with a concave region The jack may also comprise a material selected from the group consisting of steel, a refractory metal, carbide, tungsten carbide, cemented metal carbide, niobium, titanium, platinum, molybdenum, diamond, cobalt, nickel, iron, cubic boron nitride, and combinations thereof. The jack element may either be press fit into a steel sleeve bonded to the working face of the drill bit or it maybe brazed into or onto the working face of the drill bit.

The stop-off may have a melting point higher than 1000 degrees Celsius. In some embodiments, the stop-off may be boron nitride. However, in other embodiments, the stop-off may comprise a material selected from the group comprising copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, graphite, alumina or combinations thereof. The stop-off may be layered onto the jack element.

In another aspect of the invention, a method has steps for manufacturing a drill bit. A drill bit has a working face and an axis of rotation and a bit body intermediate a shank and the working face. A steel sleeve may be brazed into a pocket formed in the working face of the drill bit. A portion of the jack element may be covered with a stop-off. The stop-off may be applied to the jack element by a process of layering, dipping, spraying, brushing, flow coating, rolling, plating, cladding, silk screen printing, taping, masking or a combination thereof. The jack element may then be press fit into the steel sleeve and at least one cutting element may be brazed onto the working face adjacent the pressed fit jack element.

The stop-off may be boron nitride or it may comprise a material selected from the group comprising copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, or combinations thereof The material may be combined with an acrylic binder that is dissolved in a solvent in order to form the stop-off. The solvent may comprise xylene, toluene, butyl acetate, or a combination thereof.

The stop-off may be non-wetting to a braze used for bonding the cutting elements onto the working face or the jack element into a pocket formed in the working face. This may be beneficial in that the jack element may be protected from the braze during the manufacturing process. In some applications, the portion of the jack element may be covered with a stop-off comprising a wax or a lacquer. The jack element may have a concave region.

DETAILED DESCRIPTION OF THE INVENTION AND THE PREFERRED EMBODIMENT

Figure 1:
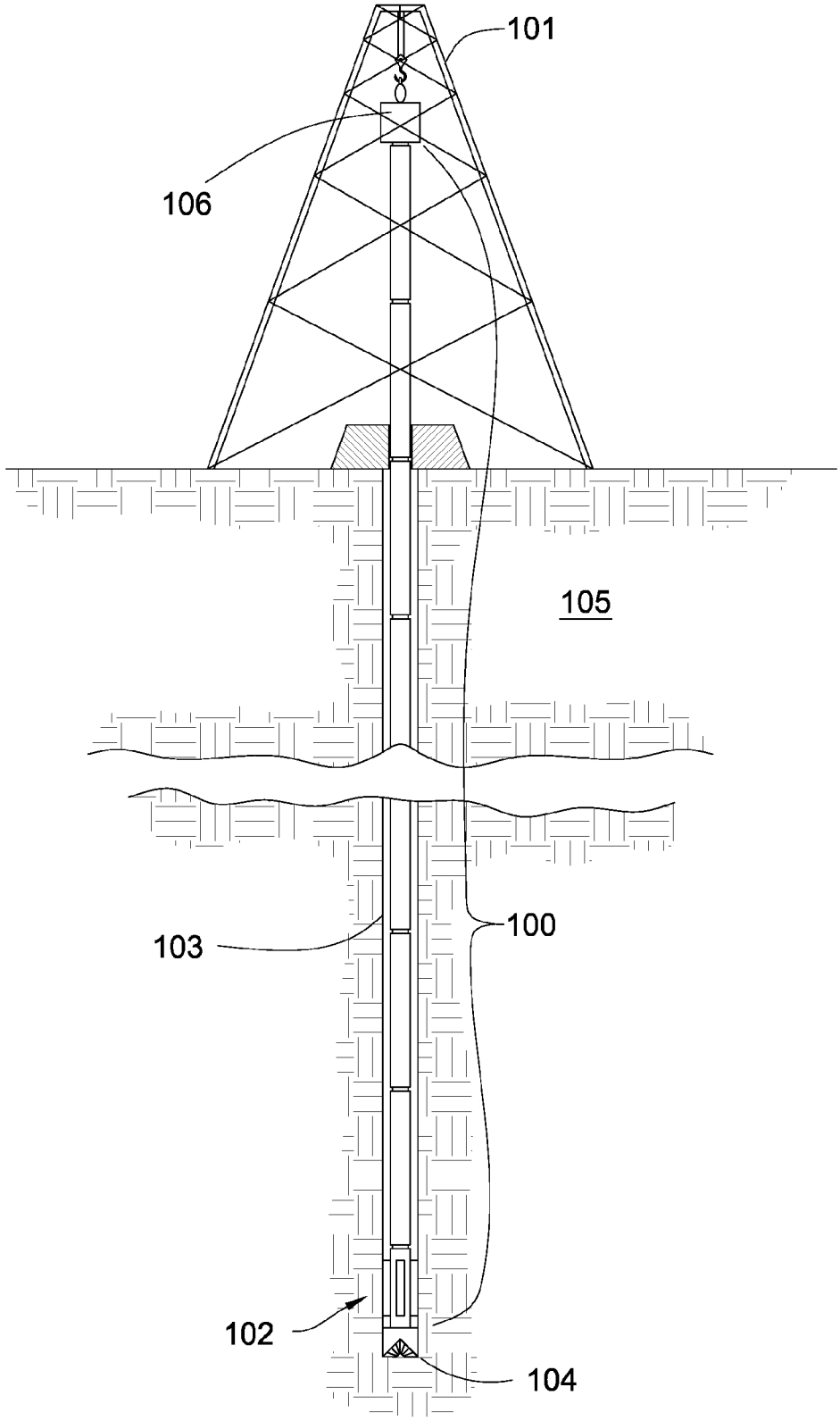
FIG. 1 is a perspective diagram of an embodiment of a drill bit suspended in a bore hole.

FIG. 1 is a perspective diagram of an embodiment of a drill string 100 suspended by a derrick 101. A bottom hole assembly 102 is located at the bottom of a bore hole 103 and comprises a drill bit 104. As the drill bit 104 rotates downhole the drill string 100 advances farther into the earth. The drill string 100 may penetrate soft or hard subterranean formations 105. The bottom hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
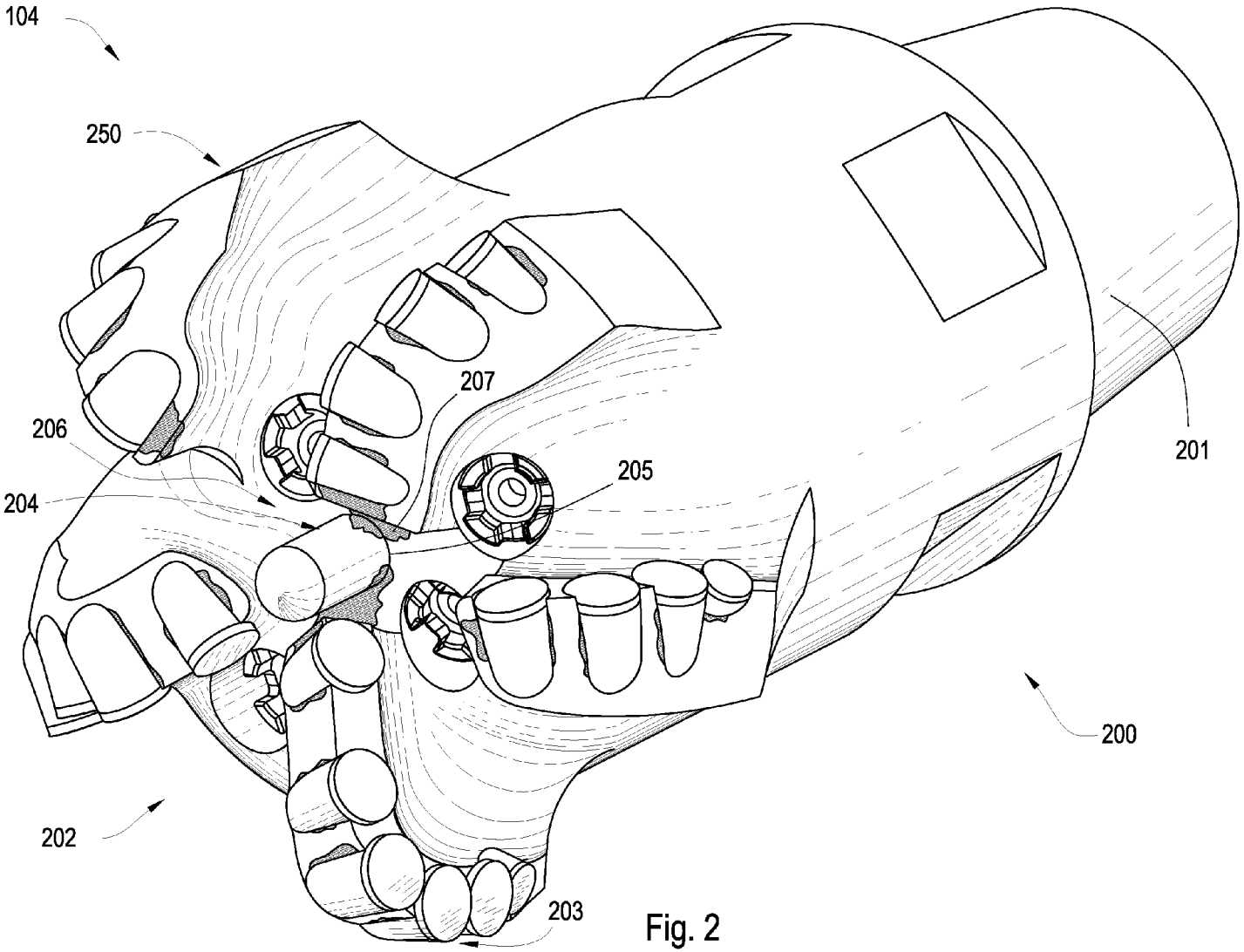
FIG. 2 is a perspective diagram of an embodiment of a drill bit.

In the preferred embodiment, a drill bit 104 may have a body 200 intermediate a shank 201 and a working face 202 as depicted in FIG. 2. A plurality blades 250 formed on the working face 202 may extend outwardly from the bit body 200, each blade 250 comprising at least one cutting element 203. A jack element 204 may extend out of an opening 205 formed in the working face 202. A portion 206 of the jack element 204 may be coated with a stop-off in order to protect the jack element 204 from a braze 207 used to braze the cutting elements 203 onto the blades 250. During the manufacturing of the drill bit comprising a jack element, high temperatures may cause excess braze 207 from the cutting elements 203 proximate the jack element 204 to melt and flow onto the jack element 204. It is believed that in some embodiments the braze 207 may weaken the jack element 204 and contribute to damage of the jack element in a downhole drilling operation. The stop-off may have a melting temperature higher than 1000 degrees Celsius. This may be necessary because of the high temperatures the drill bit 104 may be exposed to during the manufacturing process. Preferably, the melting temperature of the stop-off may be higher than a melting temperature of the braze 207. The jack element may comprise a material selected from the group consisting of a refractory metal, carbide, tungsten carbide, cemented metal carbide, niobium, titanium, platinum, molybdenum, diamond, cobalt, nickel iron, cubic boron nitride, and combinations thereof. In the preferred embodiment, the stop-off may comprise boron nitride.

Figure 3:
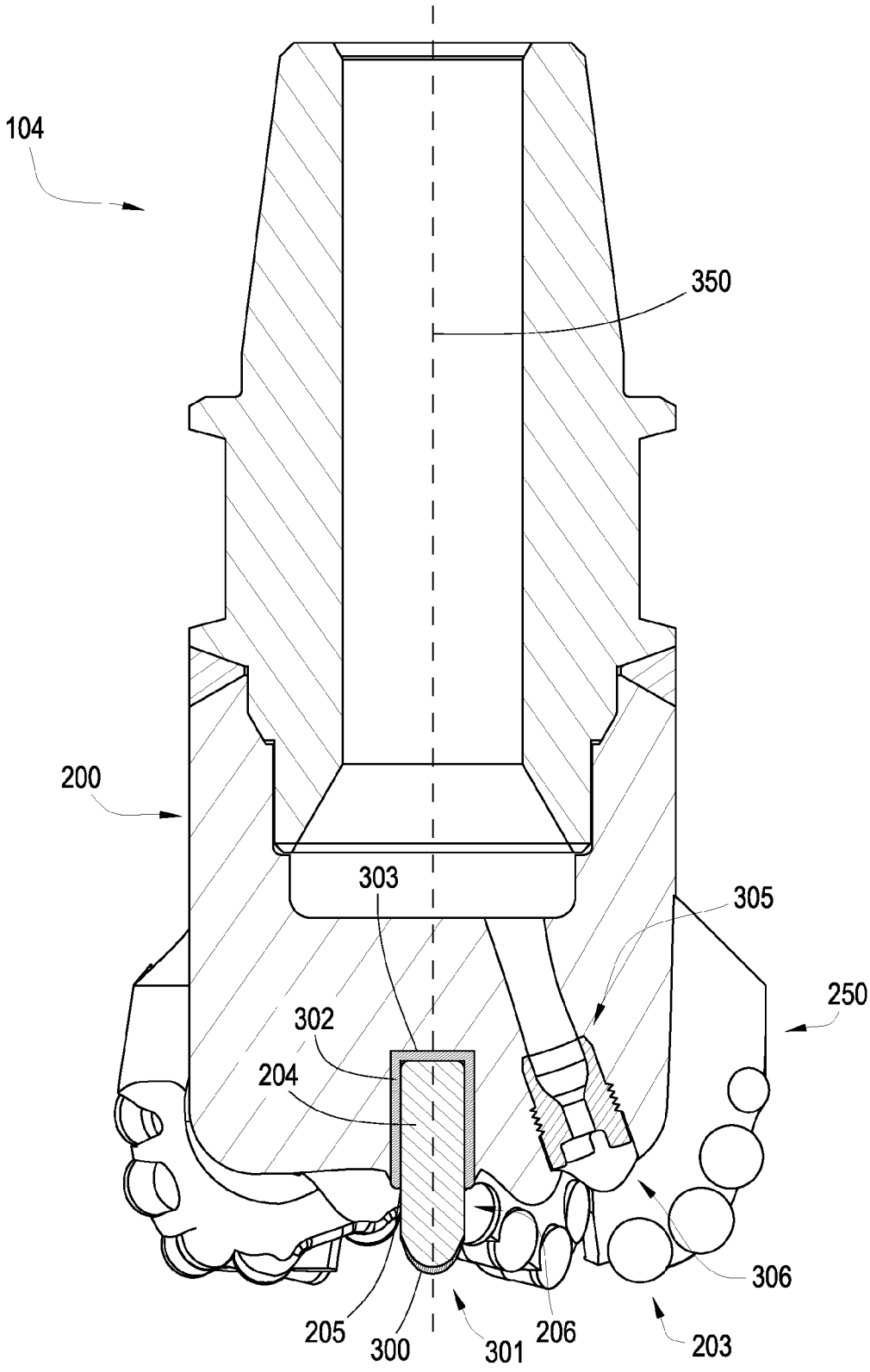
FIG. 3 is a cross-sectional diagram of an embodiment of a drill bit.

Referring now to FIG. 3, a jack element 204 coaxial with an axis of rotation 350 may extend out of an opening 205 formed in the working face 202 of the drill bit 104. A superhard tip 300 may be bonded to a distal end 301 of the jack element 204 and may comprise a material selected from the group consisting of diamond, polycrystalline diamond, natural diamond, synthetic diamond, vapor deposited diamond, silicon bonded diamond, cobalt bonded diamond, thermally stable diamond, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof The jack element 204 may be press fit into a steel sleeve 302 brazed into a pocket 303 formed in the working face 202 of the drill bit 104. The working face 202 may comprise a plurality of blades 250 that are formed to extend outwardly from the bit body 200, each of which may comprise at least one cutting element 203. Preferably, the drill bit 104 may have between three and seven blades 250. A plurality of nozzles 305 may also be fitted into recesses 306 formed in the working face 202.

A portion of the jack element 204 may be covered with a stop-off so as to prevent contact between the jack dement 204 and excess braze that may melt during the manufacturing of the drill bit 104. In some embodiments, the stop-off may cover a portion 206 of the jack element 204 extending out of the opening 205 formed in the working face 202. In other embodiments, the stop-off may cover the whole jack element 204.

Figure 3A:
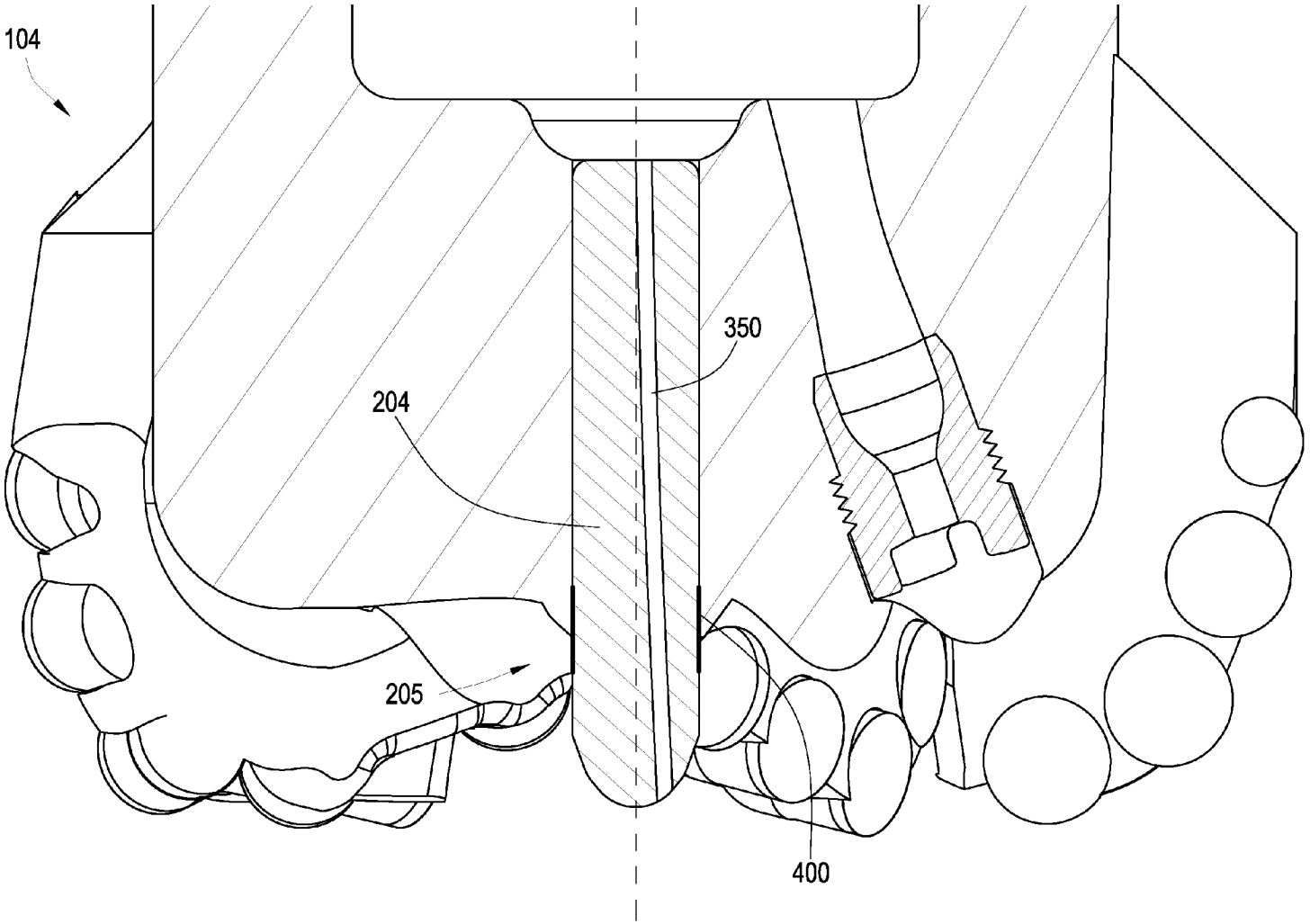
FIG. 3*a* is a cross-sectional diagram of another embodiment of a drill bit.

FIG. 3*a* discloses a drill bit 104 with a jack element 204 brazed within the opening directly to the bit body. The stop-off 400 is coated onto the portion of the jack element below and above the opening 205 of the pocket. The braze 207 is allowed to bond a majority of the surface area of the jack element to the wall of the pocket, but not the portion of the jack element proximate the opening of the pocket. In some embodiments of the invention, the jack element may have a plurality of fluid holes. These holes may also be protected from braze material with a stop-off. In some embodiments, the stop-off may actually plug off the fluid holes during manufacturing.

FIGS. 4 through 7 illustrate different embodiments of a jack element 204 extending out of the opening 205 formed in the working face 202 of the drill bit 104. The jack element 204 may be press fit into a steel sleeve 302, the steel sleeve 302 being bonded to the working face 202 of the drill bit 104. The steel sleeve 302 may be brazed within a pocket 303 formed into the working face 202. A stop-off 400 may cover a portion 206 of the jack element 204. In the preferred embodiment, the stop-off 400 may comprise boron nitride. In other embodiments, the stop-off may comprise a material selected from the group consisting of copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, graphite, alumina, or combinations thereof. The stop-off 400 may be formed by combining an aforementioned material with an acrylic binder dissolved in a solvent. The solvent may comprise xylene, toluene, butyl acetate, hydrocarbons, or a combination thereof. The solvents and binders used in forming the stop-off may be dependant on the method of applying the stop-off as well as the material composition of the jack element. The stop-off may be non-wetting to a material used to braze the cutting elements 203 onto the working face 202. It is believed that the stop-off may protect the jack element 204 from thermal fluctuations during the manufacturing process. Thermal fluctuations may be caused by the molten braze contacting the jack element, causing the jack element to expand and constrict with the changing temperatures, thus weakening the jack element.

Figure 4:
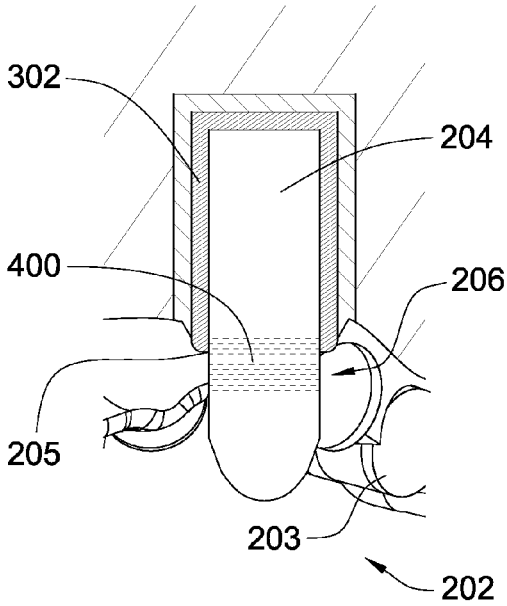
FIG. 4 is a cross-sectional diagram of another embodiment of a drill bit.
Figure 5:
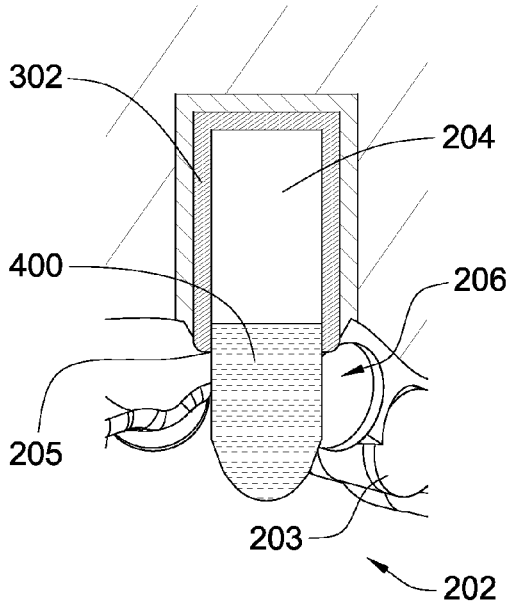
FIG. 5 is a cross-sectional diagram of another embodiment of a drill bit.
Figure 6:
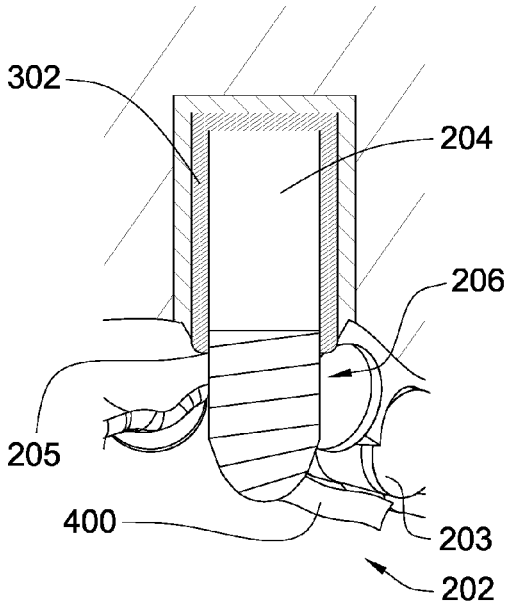
FIG. 6 is a cross-sectional diagram of another embodiment of a drill bit.
Figure 7:
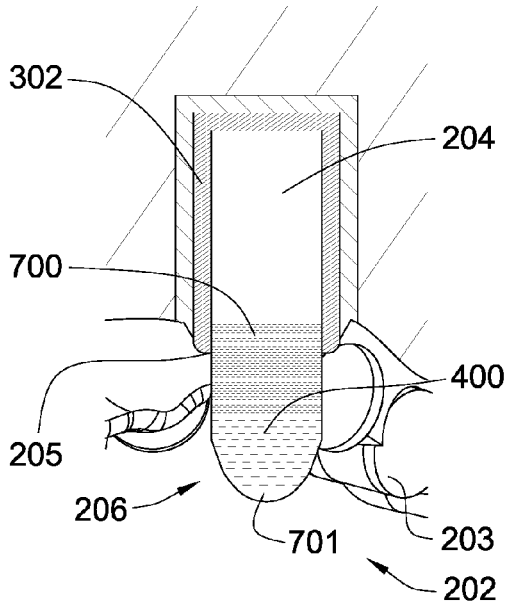
FIG. 7 is a cross-sectional diagram of another embodiment of a drill bit.

In the embodiment of FIG. 4, a stop-off 400 may cover a portion 206 of the jack element nearest the cutting elements 203. The portion 206 of the jack element 204 extending out of the drill bit may be more prone to contact with a braze from the cutting elements 203 than other portions of the jack element 204. However, as shown in the embodiment of FIG. 5, it may be beneficial to cover a larger portion 206 of the jack element with the stop-off 400 to ensure that the portion 206 of the jack element 204 is protected. In the embodiment of FIG. 6, the stop-off 400 may be applied to the jack element 204 by taping. In other embodiments, the stop-off may be applied to the jack element by a process of layering, dipping, spraying, brushing, flow coating, rolling, plating, cladding, silk screen printing, masking or a combination thereof. FIG. 7 shows a jack element 204 in which the stop-off 400 is layered. In this embodiment, the stop-off 400 may be thicker at one segment 700 of the jack element than at another segment 701 of the jack element. The amount of stop-off 400 used to cover a portion 206 of the jack element may vary along the jack element 204. Layers may be beneficial when the stop-off does not bond well to the portion of the jack element. In such a case, the undermost layer of the stop-off may form a good bond with the stop-off and the jack element.

Figure 8:
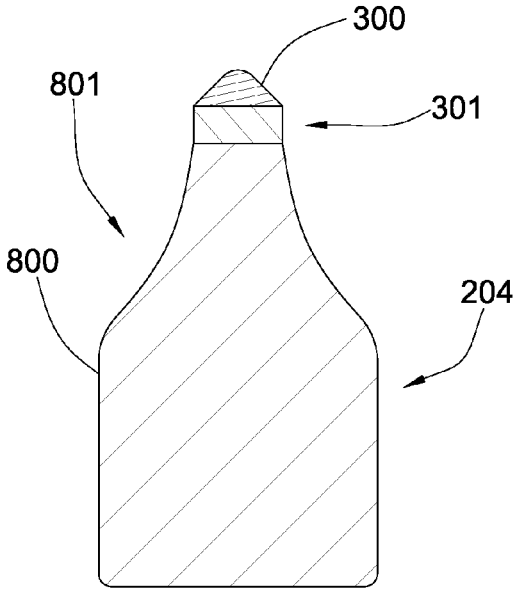
FIG. 8 is a cross-sectional diagram of an embodiment of a jack element.
Figure 9:
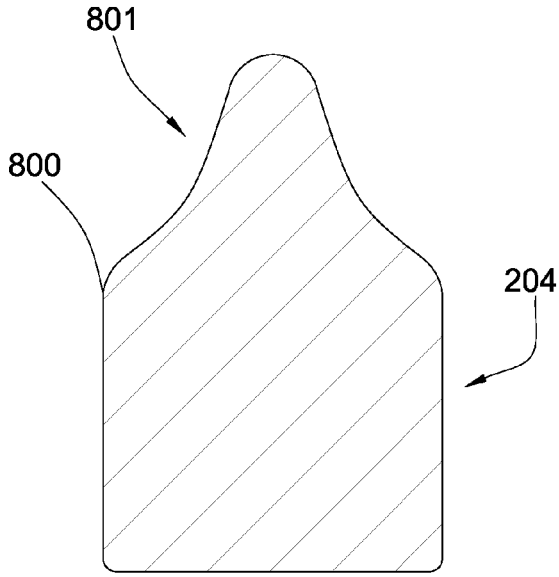
FIG. 9 is a cross-sectional diagram of another embodiment of a jack element.
Figure 10:
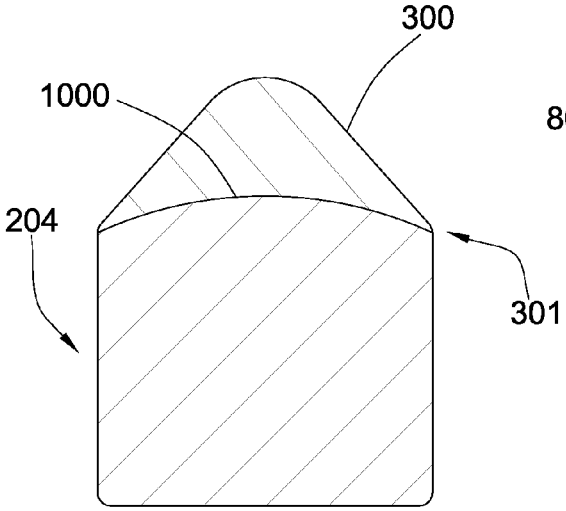
FIG. 10 is a cross-sectional diagram of another embodiment of a jack element.
Figure 11:
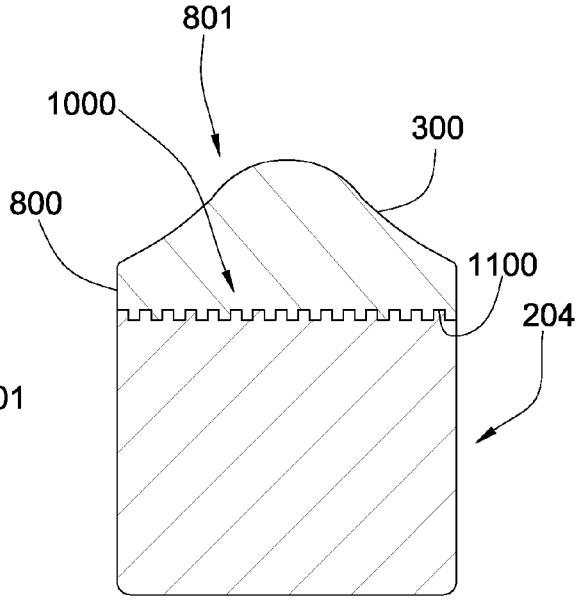
FIG. 11 is a cross-sectional diagram of another embodiment of a jack element.

FIGS. 8 through 11 show various embodiments of a jack element 204. In the preferred embodiment, the jack element 204 may have a surface 800 with a concave region 801, as shown in FIG. 8. In such embodiments, it is believed that forces exerted on the jack element 204 may be more evenly distributed throughout the jack element. A superhard tip 300 may be bonded to the distal end 301 of the jack element 204, the tip comprising a material selected from the group consisting of diamond, polycrystalline diamond, natural diamond, synthetic diamond, vapor deposited diamond, silicon bonded diamond, cobalt bonded diamond, thermally stable diamond, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The jack element 204 may comprise a material selected from the group consisting of a refractory metal, carbide, tungsten carbide, cemented metal carbide, niobium, titanium, platinum, molybdenum, diamond, cobalt, nickel, iron cubic boron nitride, and combinations thereof. In other embodiments, the jack element 204 may not have a superhard tip, as illustrated in the embodiment of FIG. 9. In this embodiment, the jack element 204 may have a surface 800 with a concave region 801. FIG. 10 discloses an embodiment of a jack element 204 with a superhard tip 300 bonded to the distal end 301 of the jack element 204. The superhard tip 300 comprises a flat-sided thick, sharp geometry as well as a curved interface 1000 between the superhard tip 300 and the jack element 204. FIG. 11 depicts a jack element 204 with a superhard tip 300 attached to the distal end 301 of the jack element 204. Nodules 1100 may be incorporated at the interface 1000 between the superhard tip 300 and the jack element 204, which may provide more surface area on the jack element to provide a stronger interface. This embodiment also shows a jack element 204 comprising a surface 800 with a concave region 801.

Figure 12:
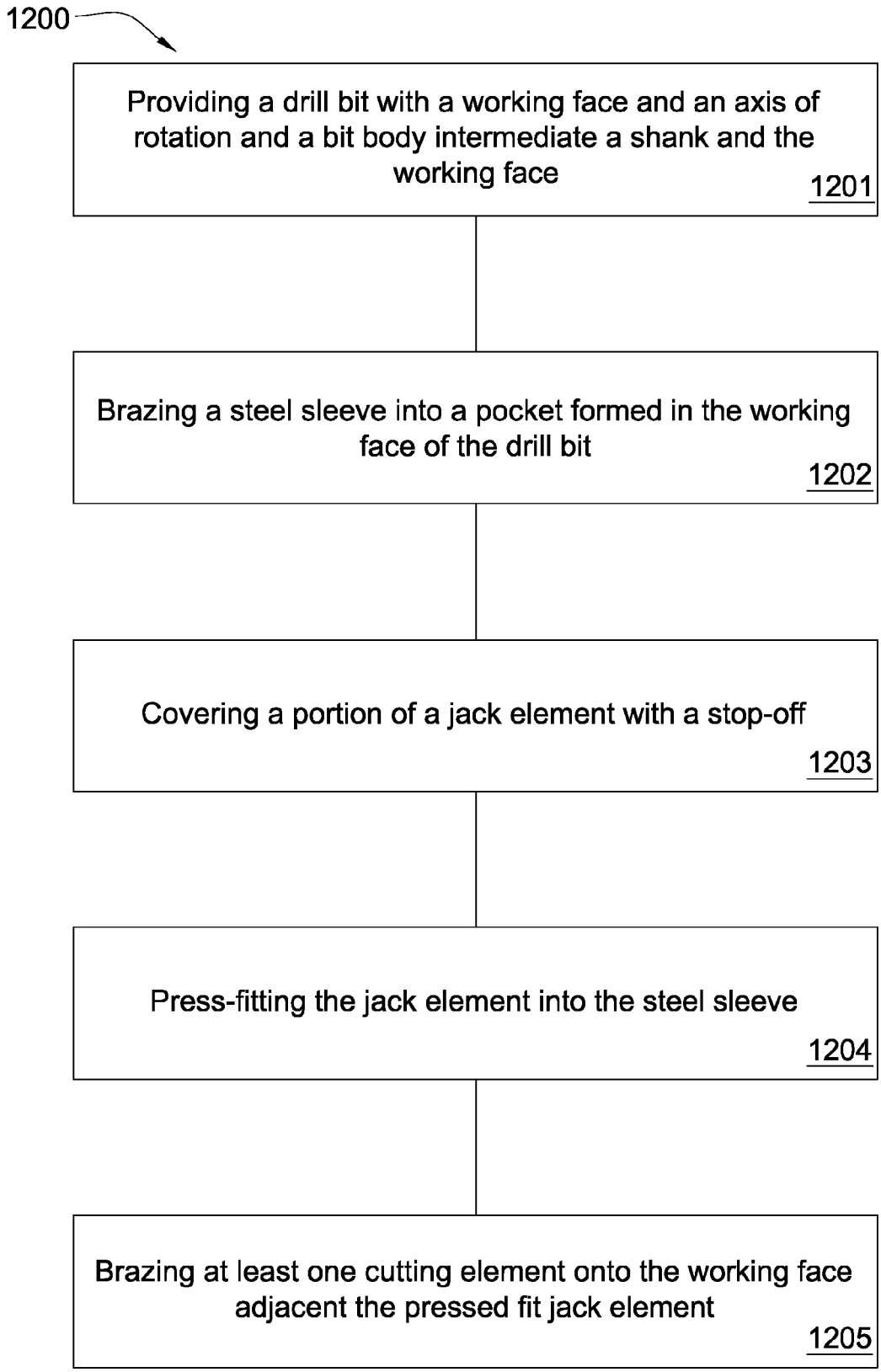
FIG. 12 is a diagram of an embodiment of a method for manufacturing a drill bit.

FIG. 12 is a diagram of an embodiment of a method 1200 for manufacturing a drill bit. The method 1200 includes providing 1201 a drill bit with a working face and an axis of rotation and a bit body intermediate a shank and the working face. The method 1200 also includes brazing 1202 a steel sleeve into a pocket formed in the working face of the drill bit. The method 1200 further includes covering 1203 a portion of a jack element with a stop-off. The stop-off preferably comprises boron nitride. However, it may comprise copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, or combinations thereof. Covering a portion of the jack element with a stop-off may include applying a wax or lacquer to the portion. The stop-off may be applied to the jack element by a process of layering, dipping, spraying, brushing, flow coating, rolling, plating, cladding, silk screen printing, taping, masking or a combination thereof. The method also includes press fitting 1204 the jack element into the steel sleeve and brazing 1205 at least one cutting element onto the working face adjacent the pressed fit jack element. The stop-off may be non-wetting to a material used in brazing the cutting elements onto the working face.

Figure 13:
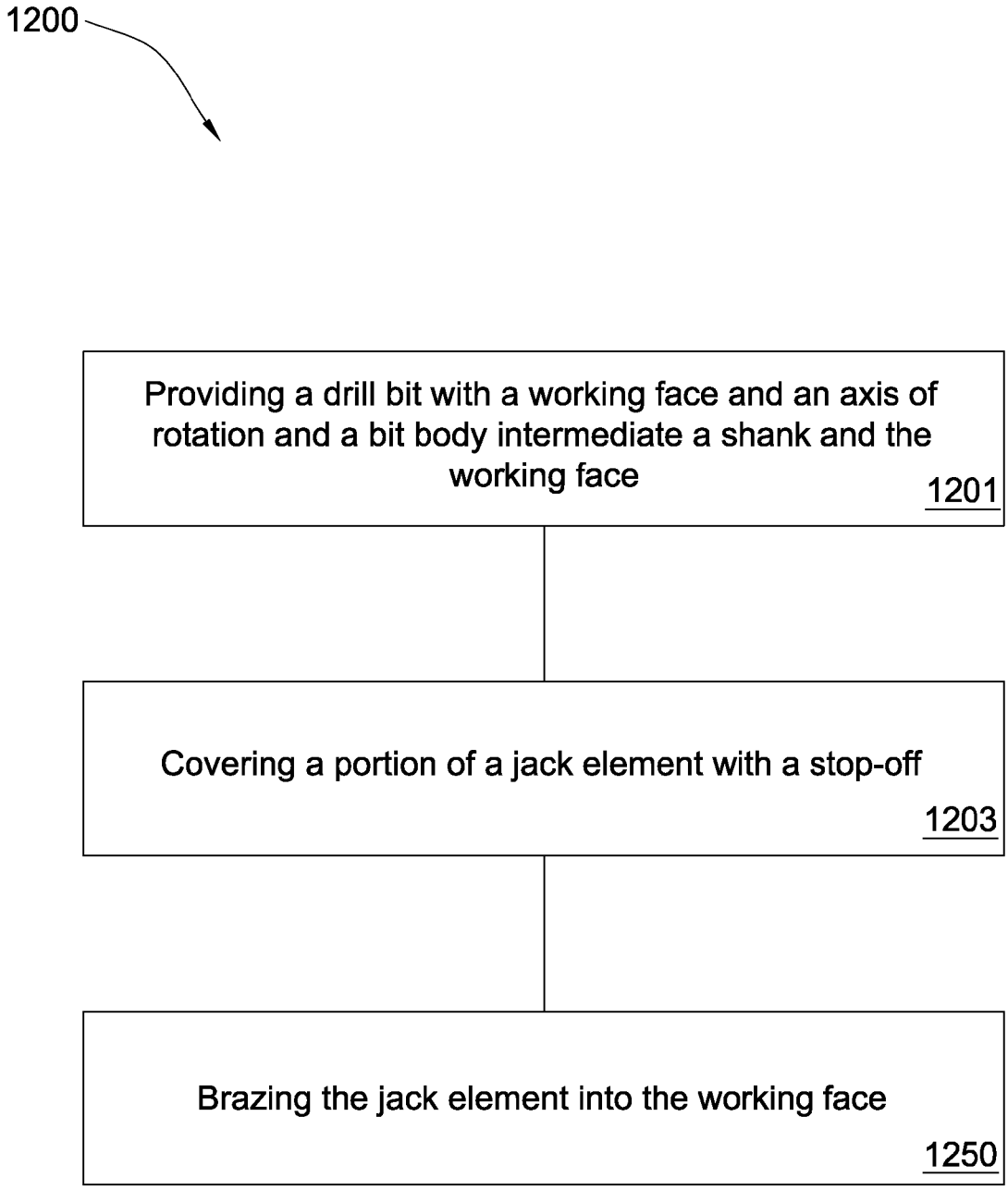
FIG. 13 is a diagram of another embodiment of a method for manufacturing a drill bit.

In FIG. 13, another method is disclosed. The method may comprise the steps of providing 1201 a drill bit with a working face and an axis of rotation and a bit body intermediate a shank and the working face; covering 1203 a portion of a jack element with a stop-off, and brazing 1250 the jack element into the working face.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:

a drill bit with a body intermediate a shank and a working face;

a plurality of blades formed on the working face and extending outwardly from the bit body, each blade comprising at least one cutting element;

a jack element coaxial with an axis of rotation and extending out of an opening formed in the working face; and a portion of the jack element covered with a stop-off;

wherein the jack element is press fit into a steel sleeve bonded to the working face of the drill bit.

2. The drill bit of claim 1, wherein a superhard tip is bonded to a distal end of the jack element.

3. The drill bit of claim 2, wherein the superhard tip comprises a material selected from the group consisting of diamond, polycrystalline diamond, natural diamond, synthetic diamond, vapor deposited diamond, silicon bonded diamond, cobalt bonded diamond, thermally stable diamond, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof.

4. The drill bit of claim 2, wherein the jack element comprises a surface with a concave region.

5. The drill bit of claim 1, wherein the jack element comprises a material selected from the group consisting of a refractory metal, carbide, tungsten carbide, cemented metal carbide, niobium, titanium, platinum, molybdenum, diamond, cobalt, nickel, iron, cubic boron nitride, and combinations thereof.

6. The drill bit of claim 1, wherein the stop-off comprises a melting point higher than 1000 degrees Celsius.

7. The drill bit of claim 1, wherein the stop-off comprises boron nitride.

8. The drill bit of claim 1, wherein the stop-off comprises a material selected from the group comprising copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, graphite, alumina, or combinations thereof.

9. The drill bit of claim 1, wherein the jack element is brazed into the drill bit.

10. A drill bit, comprising:

a drill bit with a body intermediate a shank and a working face;

a jack element coaxial with an axis of rotation and extending out of an opening formed in the working face; and a portion of the jack element being covered with a stop-off;

wherein the jack element is press fit into a steel sleeve bonded to the working face of the drill bit.

* * * * *